US006651863B1

(12) United States Patent
Chen

(10) Patent No.: US 6,651,863 B1
(45) Date of Patent: Nov. 25, 2003

(54) CAP ASSEMBLY FOR COVERING AN AIR RELEASE OPENING IN A HOUSING OF A NAIL DRIVING GUN

(75) Inventor: Robert Chen, Tai-Ping (TW)

(73) Assignee: Panrex Industrial Co., Ltd., Tai-Ping (TW)

( * ) Notice: Subject to any disclaimer, the term of this patent is extended or adjusted under 35 U.S.C. 154(b) by 0 days.

(21) Appl. No.: 10/354,712

(22) Filed: Jan. 30, 2003

(51) Int. Cl.[7] ..... B25C 1/04
(52) U.S. Cl. ..... 227/130
(58) Field of Search ..... 227/10, 130, 156, 227/8

(56) References Cited

U.S. PATENT DOCUMENTS 5,259,465 A * 11/1993 Mukoyama ..... 227/130
5,485,946 A * 1/1996 Jankel ..... 227/130
5,782,395 A * 7/1998 Sauer ..... 227/130
5,927,584 A * 7/1999 Akiba ..... 227/130
6,059,166 A * 5/2000 Ho et al. ..... 227/130
6,296,168 B1 * 10/2001 Hung ..... 227/130
6,419,141 B1 * 7/2002 Wang ..... 227/130
6,431,429 B1 * 8/2002 Canlas et al. ..... 227/130

* cited by examiner

*Primary Examiner*—Scott A. Smith
(74) *Attorney, Agent, or Firm*—Ohlandt, Greeley, Ruggiero & Perle, L.L.P.

(57) ABSTRACT

A cap assembly for a nail driving gun includes a cylindrical body mounted detachably on an open end of a gun housing. The cylindrical body includes a first flange that defines an inner space and that is formed with an external thread engaging threadedly the open end of the housing, and a second flange that is reduced from the first flange, that extends into the housing, and that defines a receiving space in fluid communication with the inner space. A nut is disposed in the inner space. A cover with an air outlet is fastened to the nut through a bolt to cover the inner space. A sealing member is movably and sealingly disposed in the housing for sealing the receiving space during a nail impelling operation.

2 Claims, 5 Drawing Sheets

CAP ASSEMBLY FOR COVERING AN AIR RELEASE OPENING IN A HOUSING OF A NAIL DRIVING GUN

FIELD OF THE INVENTION

The invention relates to a nail driving gun, more particularly to a cap assembly for covering an air release opening in a housing of the nail driving gun.

BACKGROUND OF THE INVENTION

Referring to FIG. 1, a conventional nail driving gun is shown to include a gun housing 1, a cap assembly 2, a spring-loaded sealing member 4, and a pneumatically driven piston unit 40.

As illustrated, the gun housing 1 has an inner wall 11 confining a chamber 110, a nail-discharging end 111, an open end 112 that is opposite to the nail-discharging end 111 and that defines an air release opening 112" which is in fluid communication with the chamber 110. The piston unit 40 is movably disposed in the chamber 110 for discharging a nail through the nail-discharging end 111 of the gun housing 1 upon introduction of a high pressure into the chamber 110. The cap assembly 2 is mounted detachably on the open end 112 of the gun housing 1 for covering the air release opening 112", and includes a cover 21 that is fastened detachably to an end face of the open end 112 of the gun housing 1 via a plurality of fastener bolts 3 and a packing 22, and that is formed with a plurality of air outlets 212, and a guide 23 detachably mounted on the cover 21 via a locking screw 231. The guide 23 is formed with at least one outlet hole 232 in spatial communication with the air release opening 112" through the air outlets 212 in the cover 21. The sealing member 4 is disposed sealingly and movably in the chamber 110, and is operably associated with the piston unit 40 for selectively and sealingly covering the air release opening 112" in the gun housing 1.

One drawback of the aforesaid conventional nail driving gun resides in that it is inconvenient to mount and dismount the cap assembly 2 on and from the open end 112 of the gun housing 1.

SUMMARY OF THE INVENTION

Therefore, the object of this invention is to provide a cap assembly for covering an air release opening in a gun housing of a nail driving gun, which can be mounted on or dismounted from the gun housing in a convenient manner.

A pneumatically operated nail driving gun of the present invention includes a gun housing, a cap assembly, and a sealing member. The gun housing has an inner wall confining a chamber, a nail-discharging end, and an open end that is opposite to the nail-discharging end and that defines an air release opening which is in fluid communication with the chamber. The inner wall is formed with an internal thread that extends inwardly from the open end. The cap assembly is mounted detachably on the open end of the gun housing for covering the air release opening. The cap assembly includes a cylindrical body having an annular first flange portion that confines an inner space and that is formed with an external thread engaging the internal thread of the inner wall, and an annular second flange portion that is reduced coaxially from said first flange portion, that extends into the chamber and that defines a receiving space in spatial communication with the inner space. The cap assembly further includes a nut disposed coaxially within the inner space, and a plurality of ribs which extend radially from the first flange portion to connect with the nut. A cover is detachably mounted on the first flange portion for covering the inner space, and is formed with at least one air outlet which is in fluid communication with the inner space. A fastener bolt extends through the cover, and engages the nut threadedly. The sealing member is disposed movably in the chamber, and includes a cylindrical fixed sealing part, an annular sealing ring, and a movable sealing part. The fixed sealing part is coaxially disposed within the receiving space, is secured to the nut, and cooperates with the second flange portion to define a gap therebetween. The sealing ring is coaxially disposed above the fixed sealing part and abuts against the nut. The movable sealing part is slidably and sealingly inserted into the gap, has a top end formed with an abutment end face, and is movable relative to the fixed sealing part between a first position, in which the abutment end face of the movable sealing part abuts sealingly against the sealing ring so as prevent fluid communication between the chamber and the inner space, and a second position, in which the movable sealing part moves away from the sealing ring, thereby permitting release of air through the receiving space, the inner space, and the air outlet in the cover. An urging member urges the movable sealing part to the second position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
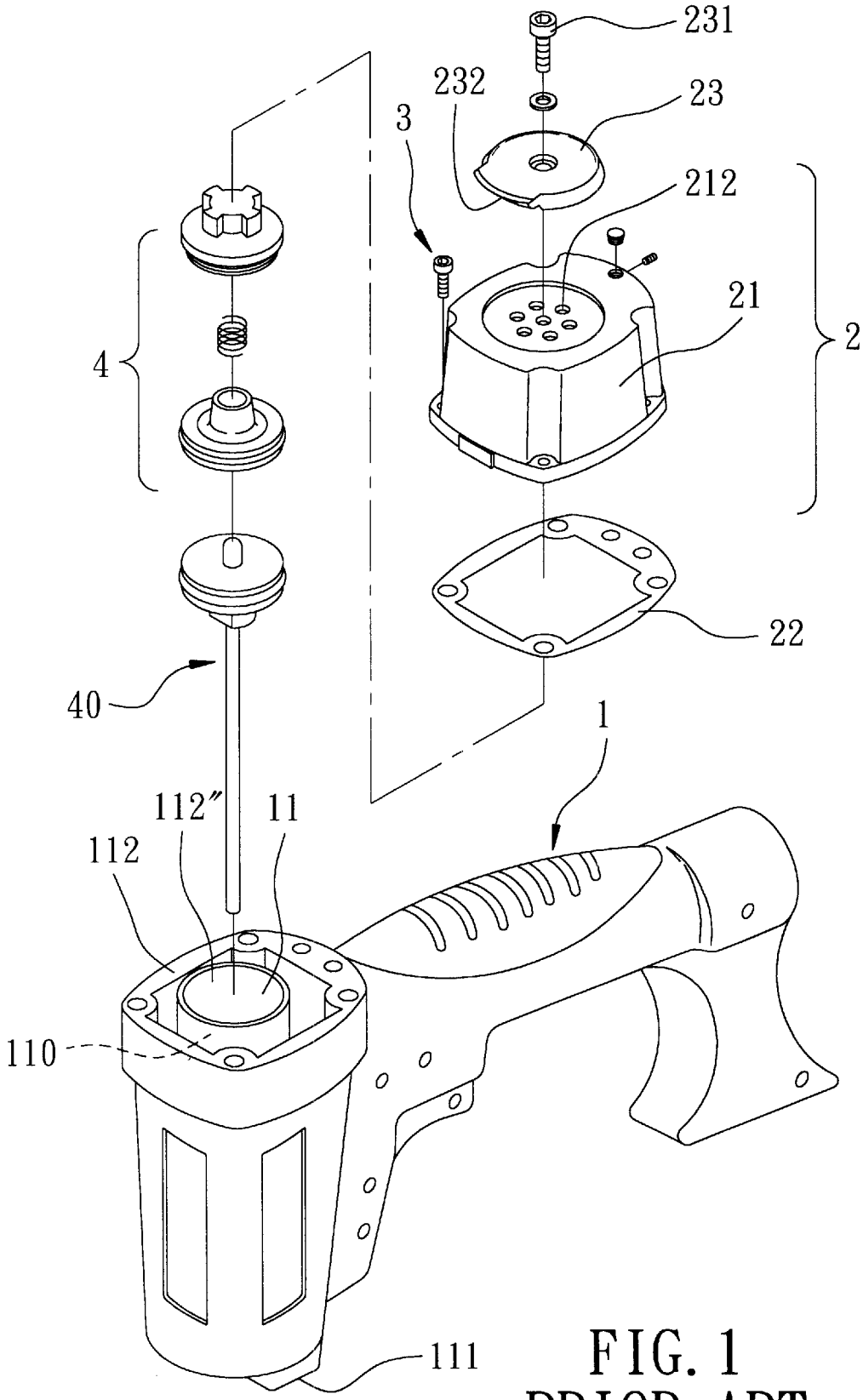
FIG. 1 PRIOR ART
FIG. 1 is an exploded perspective view of a conventional nail driving gun.
Figure 2:
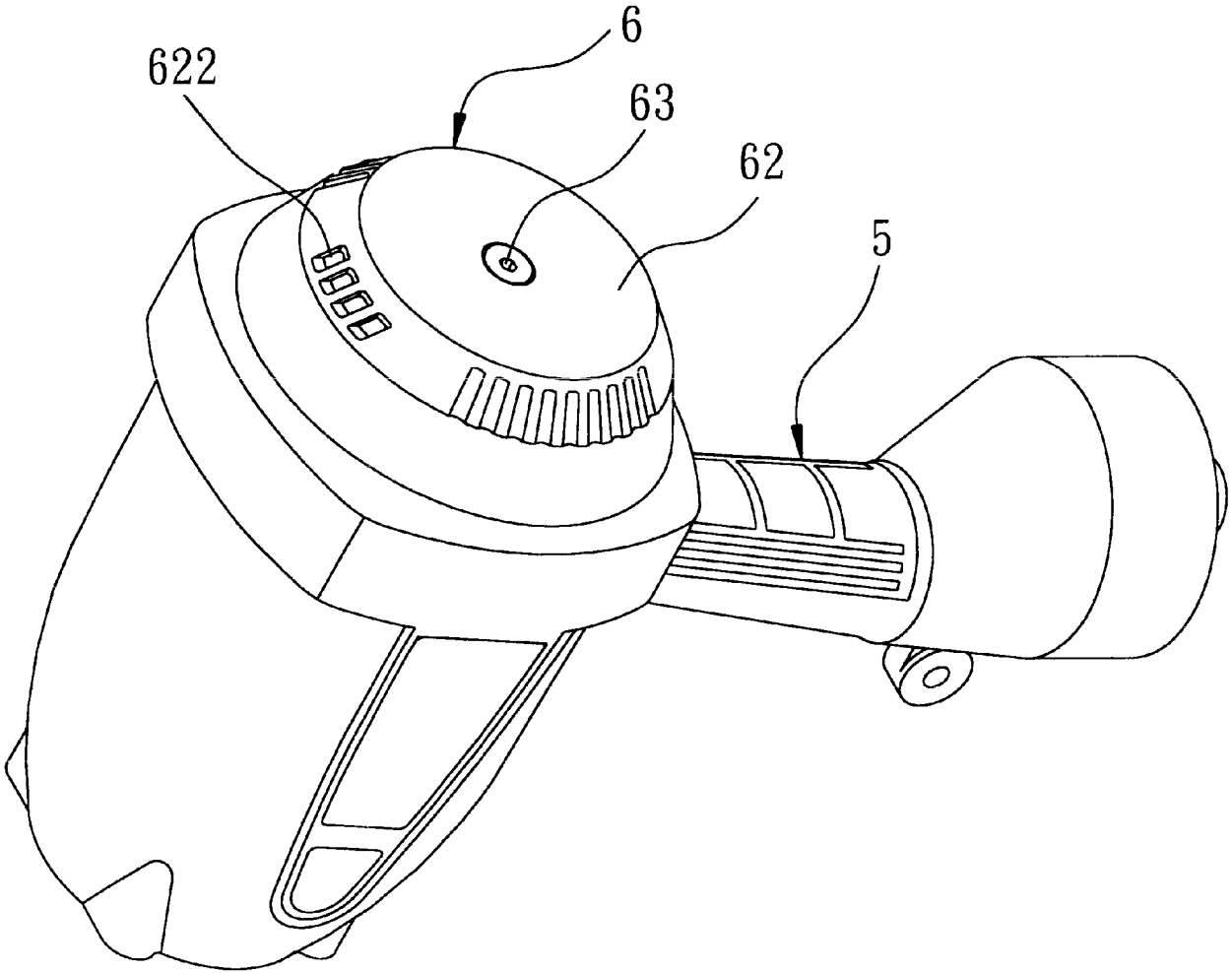
FIG. 2 is a perspective rear view of the preferred embodiment of a nail driving gun according to the present invention.
Figure 3:
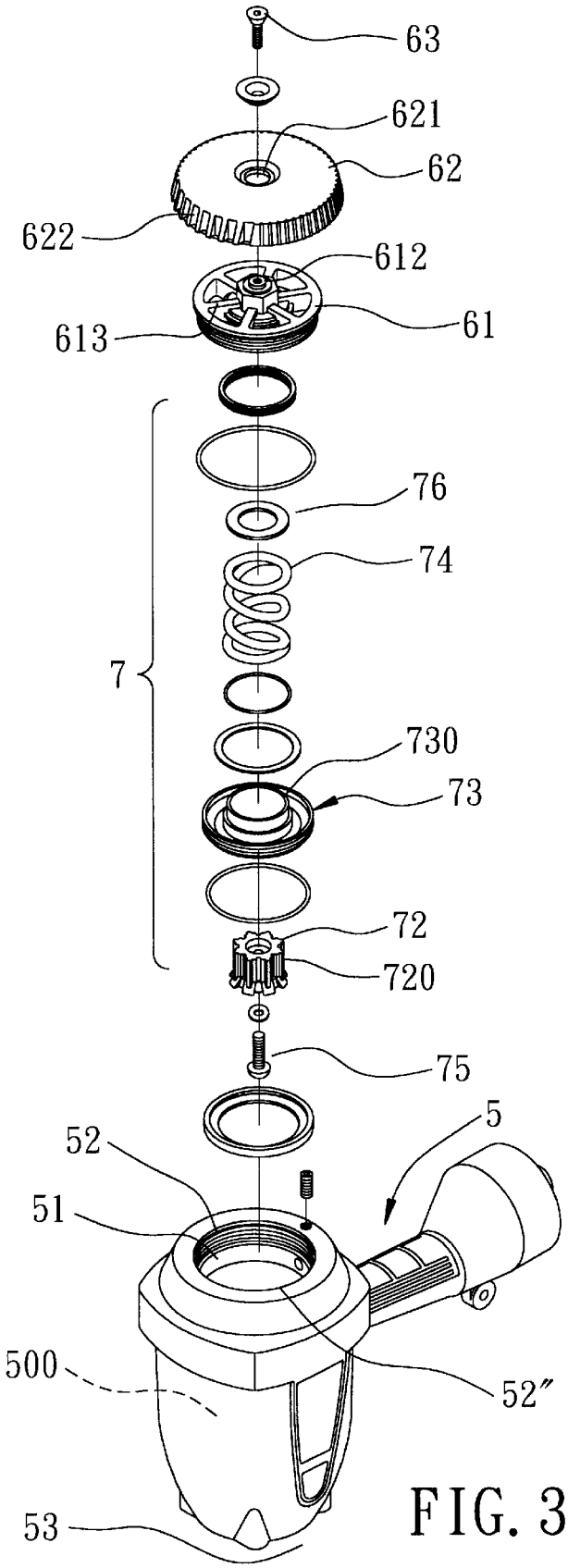
FIG. 3 is an exploded perspective rear view of the preferred embodiment.
Figure 4:
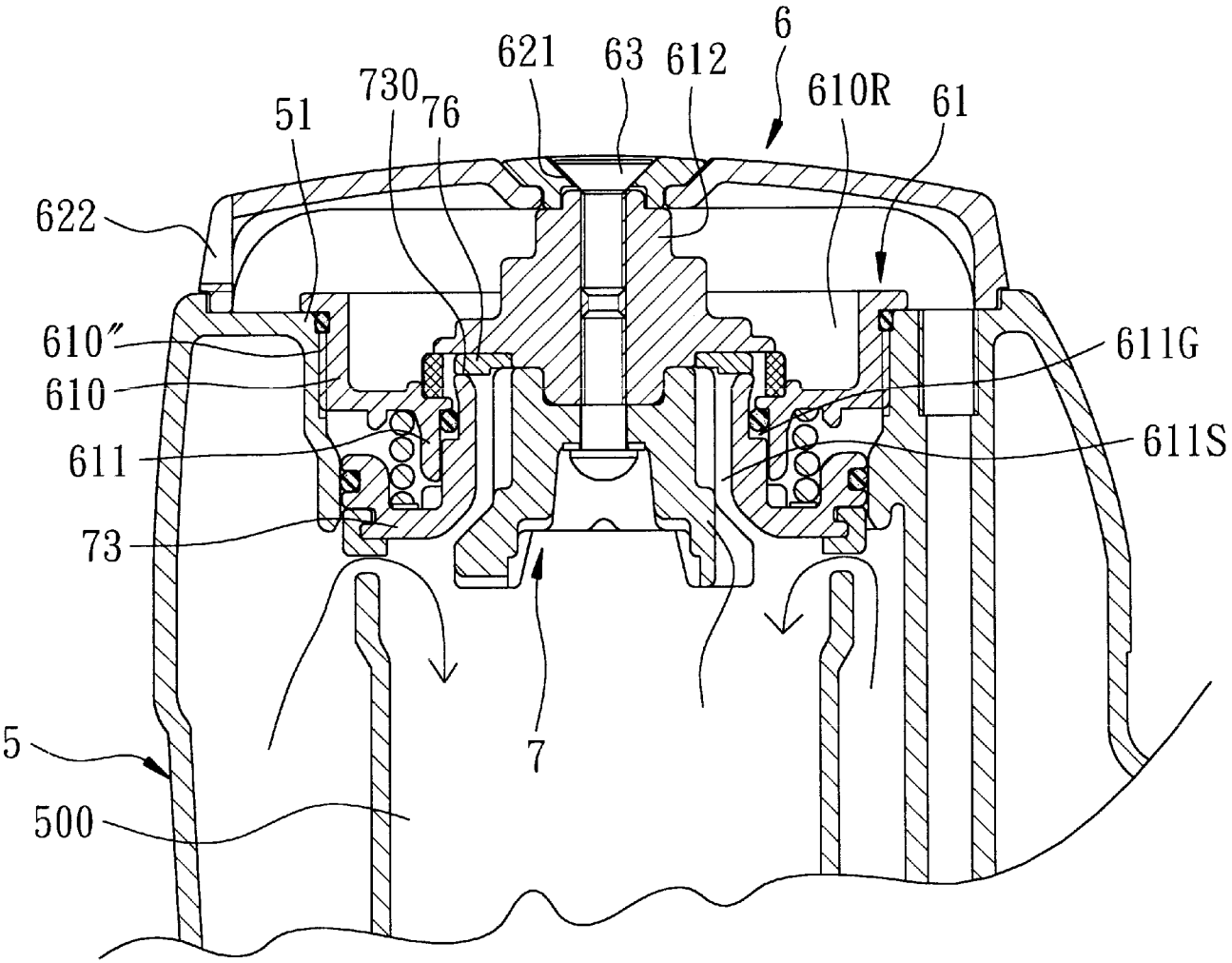
FIG. 4 is a fragmentary sectional view of the preferred embodiment, illustrating how a high pressure is introduced into a gun housing of the preferred embodiment in order to impel a nail from the gun housing.

Referring to FIGS. 2, 3 and 4, the preferred embodiment of a nail driving gun of the present invention is shown to include a gun housing 5, a cap assembly 6, and a sealing member 7.

As illustrated, the gun housing 5 has an inner wall 51 confining a chamber 500, a nail-discharging end 53, and an open end 52 that is opposite to the nail-discharging end 53 and that defines an air release opening 52" which is in fluid communication with the chamber 500. The inner wall 51 is formed with an internal thread that extends inwardly from the open end 52 of the gun housing 5.

The cap assembly 6 is mounted detachably on the open end 52 of the gun housing 5 for covering the air release opening 52". The cap assembly 6 includes a hollow cylindrical body 61, a cover 62, and a fastener bolt 63. The cylindrical body 61 has an annular first flange portion 610 that defines an inner space 610R and that is formed with an external thread 610" engaging threadedly the internal thread of the inner wall 51, and an annular second flange portion 611 that is reduced coaxially from the first flange portion 610, that extends into the chamber 500, and that defines a receiving space 611S in spatial communication with the inner space 610R. The cap assembly 6 further includes a nut 612 disposed coaxially within the inner space 610R, and a plurality of ribs 613 which extend radially from the first flange portion 610 to connect with the nut 612. The cover 62 is detachably mounted on the first flange portion 610 for covering the inner space 610R, and is formed with a plurality of air outlets 622 which are in fluid communication with the inner space 610R. The fastener bolt 63 extends through a hole 621 in the cover 62 and engages the nut 612 threadedly.

Figure 5:
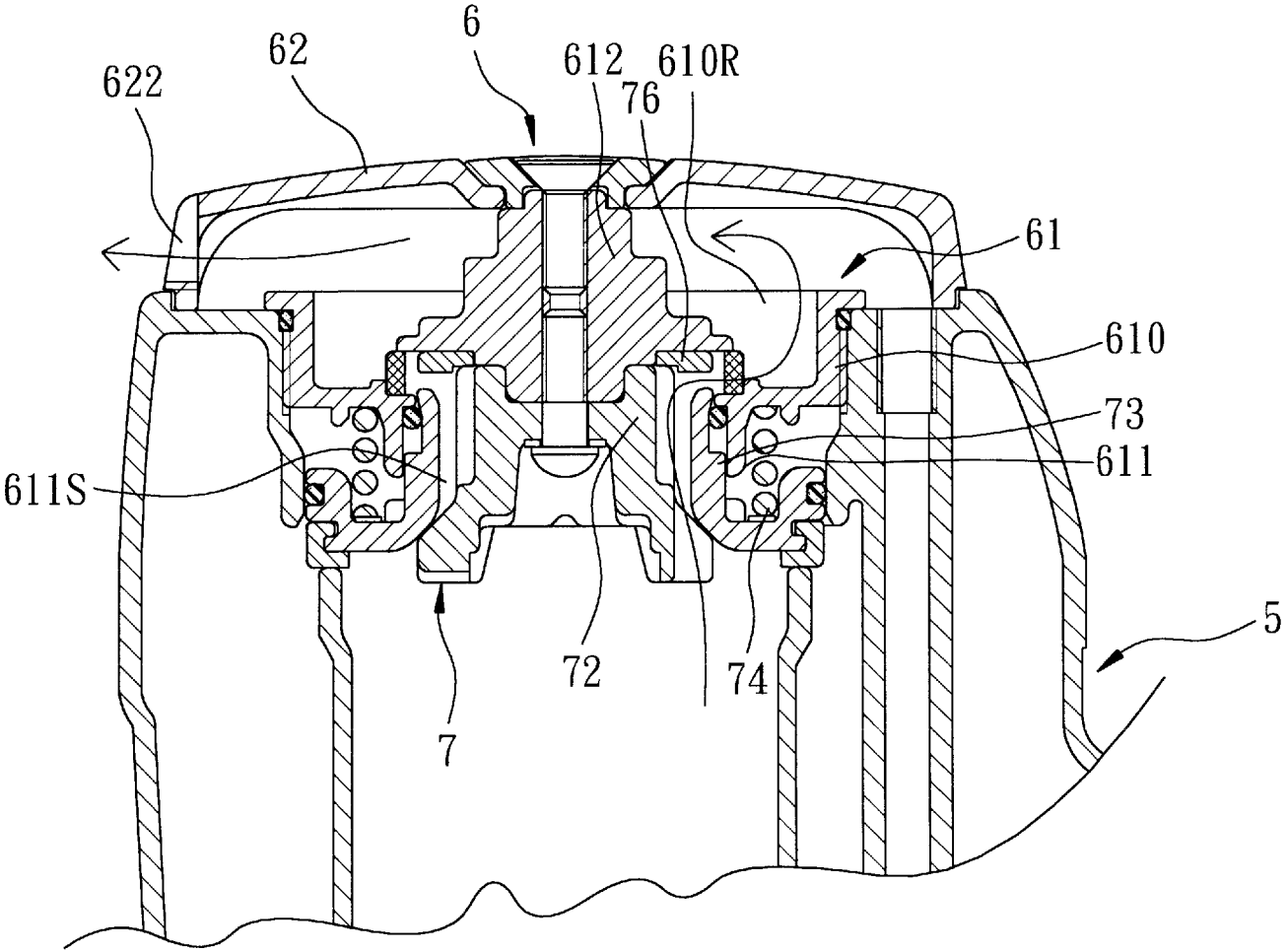
FIG. 5 is a fragmentary sectional view of the preferred embodiment, illustrating how the pressure within the gun housing is released through a cap assembly that is mounted on an open end of the gun housing.

The sealing member 7 is disposed movably in the chamber 500 of the gun housing 5, and includes a cylindrical fixed sealing part 72, a sealing ring 76, and a movable sealing part 73. The fixed sealing part 72 is coaxially disposed within the receiving space 611S, is secured to the nut 612 through a locking bolt 75, and cooperates with the second flange portion 611 to define a gap 611G therebetween (see FIG. 4). The sealing ring 76 is coaxially disposed above the fixed sealing part 72, and abuts against the nut 612. The movable sealing part 73 has a top end formed with an annular abutment end face 730, and is inserted sealingly and slidably into the gap 611G. The movable sealing part 73 is movable relative to the fixed sealing part 72 between a first position, in which the abutment end face 730 of the movable sealing part 73 abuts sealingly against the sealing ring 76 so as to prevent fluid communication between the chamber 500 and the inner space 610R, as best shown in FIG. 4, and a second position, in which the movable sealing part 73 moves away from the sealing ring 76, thereby permitting release of air through the receiving space 611S, the inner space 610R, and the air outlets 622 in the cover 62, as best shown in FIG. 5.

The fixed sealing part 72 is preferably formed with a plurality of axial grooves 720 for passage of air therethrough when the movable sealing part 73 is positioned at the second position.

An urging member in the form a compression spring 74 is sleeved around the movable sealing part 73, and urges the movable sealing part 73 to the second position.

Preferably, a pneumatically driven piston unit (not shown) is movably disposed in the chamber 500 of the gun housing 5. The piston unit is adapted to discharge a nail through the nail-discharging end 53 of the gun housing 5 upon introduction of a high pressure into the chamber 500. The movable sealing part 73 moves to the first position against the urging force of the compression spring 74 once the high pressure is introduced into the chamber 500 so as to sealingly close the receiving space 611S. Immediately after the nail impelling operation, the movable sealing part 73 returns to the second position by virtue of a restoration force of the compression spring 74. At this time, the pressure within the chamber 500 is released through the receiving space 611S, the inner space 610R, and the air outlets 622 in the cover 62, as indicated by the arrow in FIG. 5.

The ribs 613 interconnecting the nut 612 and the first flange portion 610 facilitate turning operation of the cylindrical body 61 relative to the open end 52 of the gun housing 5. With the cap assembly of this invention, the aforesaid drawback associated with the prior nail driving gun can be eliminated.

With this invention thus explained, it is apparent that numerous modifications and variations can be made without departing from the scope and spirit of this invention. It is therefore intended that this invention be limited only as indicated in the appended claims.

I claim:

1. A pneumatically operated nail driving gun comprising:

a gun housing having an inner wall confining a chamber, a nail-discharging end, and an open end that is opposite to said nail-discharging end and that defines an air release opening which is in fluid communication with said chamber, said inner wall being formed with an internal thread that extends inwardly from said open end;

a cap assembly mounted detachably on said open end of said gun housing for covering said air release opening, said cap assembly including a hollow cylindrical body having an annular first flange portion that confines an inner space and that is formed with an external thread engaging threadedly said internal thread of said inner wall, and an annular second flange portion that is reduced coaxially from said first flange portion, that extends into said chamber, and that defines a receiving space in spatial communication with said inner space, said cap assembly further including a nut disposed coaxially within said inner space, and a plurality of ribs which extend radially from said first flange portion to connect with said nut, said cap assembly further including a cover that is detachably mounted on said first flange portion for covering said inner space, and that is formed with at least one air outlet which is in fluid communication with said inner space, and a fastener bolt extending through said cover and engaging threadedly said nut;

a sealing member disposed movably in said chamber, and including a cylindrical fixed sealing part that is coaxially disposed within said receiving space, that is secured to said nut, and that cooperates with said second flange portion to define a gap therebetween, said sealing member further including an annular sealing ring disposed coaxially above said fixed sealing part and abutting against said nut, and a movable sealing part that is slidably and sealingly inserted into said gap, that has a top end formed with an abutment end face, and that is movable relative to said fixed sealing part between a first position, in which said abutment end face of said movable sealing part abuts sealingly against said sealing ring so as to prevent fluid communication between said chamber and said inner space, and a second position, in which said movable sealing part moves away from said sealing ring, thereby permitting release of air through said receiving space, said inner space, and said air outlet in said cover; and an urging member for urging said movable sealing part to said second position.

2. The nail driving gun as defined in claim 1, wherein said fixed sealing part is formed with a plurality of axial grooves.

* * * * *